US007174681B2

(12) United States Patent
Wilson et al.

(10) Patent No.: US 7,174,681 B2
(45) **Date of Patent: *Feb. 13, 2007**

(54) CONCRETE FROM STAKE SYSTEM WITH SELF-SEALING PLUG

(75) Inventors: Robert J. Wilson, West Palm Beach, FL (US); Gregory S. Foster, West Palm Beach, FL (US)

(73) Assignee: Vista Investments and Properties, LLC, West Palm Beach, FL (US)

( * ) Notice: Subject to any disclaimer, the term of this patent is extended or adjusted under 35 U.S.C. 154(b) by 91 days.

This patent is subject to a terminal disclaimer.

(21) Appl. No.: 10/733,901

(22) Filed: Dec. 11, 2003

(65) Prior Publication Data

US 2005/0126108 A1 Jun. 16, 2005

(51) Int. Cl.
*E02D 19/00* (2006.01)

(52) U.S. Cl. ..... 52/169.14; 52/165; 52/169.5; 52/293.1; 52/294; 52/742.14; 404/98; 249/5; 249/13; 249/34; 249/192; 249/207; 249/210

(58) Field of Classification Search ..... 52/155–157, 52/294, 169.5, 677, 678, 684, 699, 700, 153, 52/165, 293.1, 4, 23, 169.14, 741.13, 741.15, 52/742.14, 272–274; 411/489, 480, 923; 404/47–50, 96, 98; 249/5, 13, 14, 208, 216, 249/2, 3, 6, 7, 18, 34, 47, 207, 210, 192, 249/196; 248/533, 156, 530; 135/118, 119
See application file for complete search history.

(56) References Cited

U.S. PATENT DOCUMENTS

| | | | | | |
|---|---|---|---|---|---|
| 911,504 | A * | 2/1909 | Jay | 52/156 |
| 1,814,521 | A * | 7/1931 | Miller | 249/3 |
| 2,840,092 | A * | 6/1958 | Hill | 135/118 |
| 2,846,748 | A * | 8/1958 | Yates et al. | 249/7 |
| 2,978,840 | A * | 4/1961 | Tatsch | 52/169.5 |
| 3,300,920 | A * | 1/1967 | Skaare | 52/150 |
| 3,401,612 | A * | 9/1968 | Tone | 249/3 |
| 3,613,323 | A * | 10/1971 | Hreha | 52/169.5 |
| 3,785,606 | A * | 1/1974 | Green | 249/3 |
| 4,156,332 | A * | 5/1979 | Thompson | 52/165 |
| 4,162,789 | A * | 7/1979 | Hollaway | 473/499 |
| 4,251,971 | A | 2/1981 | Unthank | |
| 4,443,981 | A | 4/1984 | Weiss | |
| 4,455,104 | A * | 6/1984 | Weisbach | 404/50 |
| 4,516,875 | A * | 5/1985 | Turner | 404/50 |
| 4,572,701 | A | 2/1986 | Parsons et al. | |
| 4,635,895 | A * | 1/1987 | Johnson et al. | 249/5 |
| 4,679,369 | A | 7/1987 | Kinsley et al. | |

(Continued)

FOREIGN PATENT DOCUMENTS

JP 10191734 A2 7/1998

*Primary Examiner*—Jeanette E. Chapman
*Assistant Examiner*—Yvonne M. Horton
(74) *Attorney, Agent, or Firm*—Sacco & Associates, PA; Robert J. Sacco

(57) ABSTRACT

Method and apparatus for securing a building foundation form disposed on a moisture barrier membrane. The method includes the steps of positioning one end of a concrete form stake in a mating structure of a plug, penetrating the moisture barrier membrane with a tip end the plug, and forming a seal between a flange extending around a periphery of the plug and the moisture barrier membrane.

38 Claims, 5 Drawing Sheets

U.S. PATENT DOCUMENTS 4,738,060 A * 4/1988 Marthaler et al. ..... 52/103
5,046,699 A * 9/1991 Perreault et al. ..... 248/533
5,380,122 A * 1/1995 Rambo et al. ..... 404/47
5,475,950 A * 12/1995 Palmer ..... 52/169.5
5,564,232 A * 10/1996 Callaway ..... 5/4
5,586,416 A 12/1996 Hess, III et al.
5,722,205 A * 3/1998 Gannaway ..... 52/155
5,830,378 A 11/1998 Butler
5,884,439 A 3/1999 Hess, III et al.
5,931,603 A * 8/1999 Swain et al. ..... 405/229
6,021,994 A * 2/2000 Shartzer, Jr. ..... 249/6
6,095,081 A * 8/2000 Gochenour ..... 116/209
6,123,745 A * 9/2000 Hess et al. ..... 52/677
6,176,462 B1 * 1/2001 Jansen ..... 249/3
6,202,368 B1 * 3/2001 Wallace, III ..... 52/157
6,272,798 B1 * 8/2001 Cockman ..... 52/155
6,308,468 B1 * 10/2001 Caruso ..... 52/165
6,349,514 B1 2/2002 Adams
6,367,764 B1 4/2002 Butler
6,536,737 B1 * 3/2003 Davis ..... 249/3
6,547,203 B1 4/2003 Willard
6,550,213 B1 * 4/2003 Butler ..... 52/741.15
6,742,758 B2 * 6/2004 Janesky ..... 249/7
6,899,187 B1 * 5/2005 McCarthy ..... 175/19
2005/0126111 A1 * 6/2005 Wilson et al. ..... 52/741.1

* cited by examiner

CONCRETE FROM STAKE SYSTEM WITH SELF-SEALING PLUG

BACKGROUND OF THE INVENTION

1. Statement of the Technical Field

The inventive arrangements relate generally to the field of building construction and more particularly to construction methods for concrete forms.

2. Description of the Related Art

Plastic membranes are commonly used in the construction industry to prevent moisture penetration through floors. The membranes are typically formed of polyethylene or other damp proof materials. Another advantage of such membranes is that they can help prevent intrusion into a construction by insects, such as subterranean termites. A poured, reinforced, crack-free concrete foundation hinders the passage of termites. However, most slabs have some minor cracks in them are created as a result of movements induced by stress, drying shrinkage or temperature variations. In this regard, studies have shown that termites can pass through a crack as small as 1.4 mm and will even widen existing cracks, depending on the relative strength of the concrete. Accordingly, a plastic membrane can help prevent the intrusion of termites in the event that any cracks should occur.

A typical construction will involve the placement of the membrane over a compacted soil surface where a concrete foundation or pad is to be poured. In preparation for pouring a foundation, concrete forms are placed at various locations around the perimeter of the pad and anywhere else they are needed. The forms are generally positioned on top of the moisture barrier membrane and held in place using long stakes that are driven through the membrane and into the soil. The concrete is then poured on top of the moisture barrier and within the confined area defined by the concrete forms. Finally, the stakes are removed as the concrete begins to set.

The foregoing approach has been used for many years with good results, but it is not without its drawbacks. For example, the moisture barrier's effectiveness can be seriously compromised by the existence of any punctures or tears that allow moisture or insects direct access to the concrete. Even if great care is used to lay the membrane, punctures inevitably result when the stakes are driven into the soil to hold the concrete forms in place. This is a serious problem as it allows for the intrusion of moisture and insects behind the moisture barrier. Despite the obvious flaws in this approach, it continues to be used extensively in the construction trade because there has been no satisfactory alternative approach available.

SUMMARY OF THE INVENTION

The invention concerns a method and apparatus for securing a foundation form disposed on a moisture barrier membrane. The method includes the steps of positioning one end of a concrete form stake in a mating structure of a plug, penetrating the moisture barrier membrane with a tip end the plug, and forming a seal between a flange extending around a periphery of the plug and the moisture barrier membrane. The method can also include the step of forming the seal by driving the stake through the moisture barrier membrane until the flange is disposed adjacent to the moisture barrier membrane. The flange can be selected so as to include a flexible portion for more effectively forming the seal with the moisture barrier membrane. The seal between the flange and the moisture barrier membrane can be enhanced by using a sealing material such as an adhesive or silicone rubber sealant. For example, the flange can include an adhesive sealant pre-disposed on a surface thereof. The stake can be secured to the foundation form. This can be accomplished by driving at least one of a nail and a screw through a bore formed in the stake and into the foundation form. Thereafter the method can include pouring concrete over the moisture barrier membrane and removing the stake from the mating structure.

According to one aspect, the mating structure of the plug can be selected so that the stake is removable from the plug after the seal has been formed. For example, the method can include the step selecting the mating structure of the plug to include a bore that is shaped for receiving a portion of the stake. According to another aspect of the invention, the method can include selecting the flange of the plug to include a ridge disposed on an outer rim thereof. A pesticide can be disposed in a channel at least partially defined by the ridge.

According to another embodiment of the invention, a method for securing a foundation form disposed on a moisture barrier membrane can include the steps of penetrating the moisture barrier membrane with a plug disposed on one end of a stake, sealing a breach in the moisture barrier membrane caused by the penetrating step by forming a seal around a periphery of the plug, and removing at least a portion of the stake extending above the moisture barrier membrane. The method can also include positioning the stake in a mating structure of the plug that is shaped for receiving an end of the stake. The seal can be formed, at least in part, by abutting a peripheral flange of the plug adjacent to the moisture barrier membrane. The removing step described above can include removing the stake from the mating structure after concrete has been poured over the moisture barrier membrane.

According to one aspect of the invention, the method can include selecting the flange to include at least one of a flexible and a resilient portion that forms a seal with the moisture barrier membrane. The seal between the flange and the moisture barrier membrane can be enhanced using an adhesive and/or a sealant. Further the flange can be selected so as to include an adhesive pre-disposed on a surface thereof.

The method further include selecting the stake to include at least one bore extending through the stake in a direction transverse to an axis defined along a length of the stake and securing the stake to the foundation form. The securing step can be further comprised of driving at least one of a nail and a screw through a bore, formed in the stake transverse to an axis defined along a length of the stake. The nail or screw can be driven into the foundation form.

According to yet another embodiment, the invention can comprise an apparatus for securing a foundation form disposed on a moisture barrier membrane. The apparatus can include an elongated stake and a plug disposed on an end of the stake. The plug can have a peripheral flange configured for forming a seal with a moisture barrier membrane surrounding an elongated body portion of the plug. A sealing material can be pre-disposed on a surface of the flange. According to one aspect, the plug can include at least one of a flexible portion and a resilient portion. For example, the flange can be formed as a resilient or flexible portion to enhance it sealing ability.

The plug can include a mating structure for removably attaching the plug to the stake. For example, the plug can be slidably removable from the stake. According to one embodiment, the mating structure can comprise a bore disposed within the stake that is profiled for removably receiving the stake therein. The flange provided on the periphery of the plug can include a ridge disposed on an outer rim thereof spaced apart from the bore that at least partially forms a channel on the flange configured for receiving a fluid insecticide.

DETAILED DESCRIPTION OF THE PREFERRED EMBODIMENTS

Figure 1A:
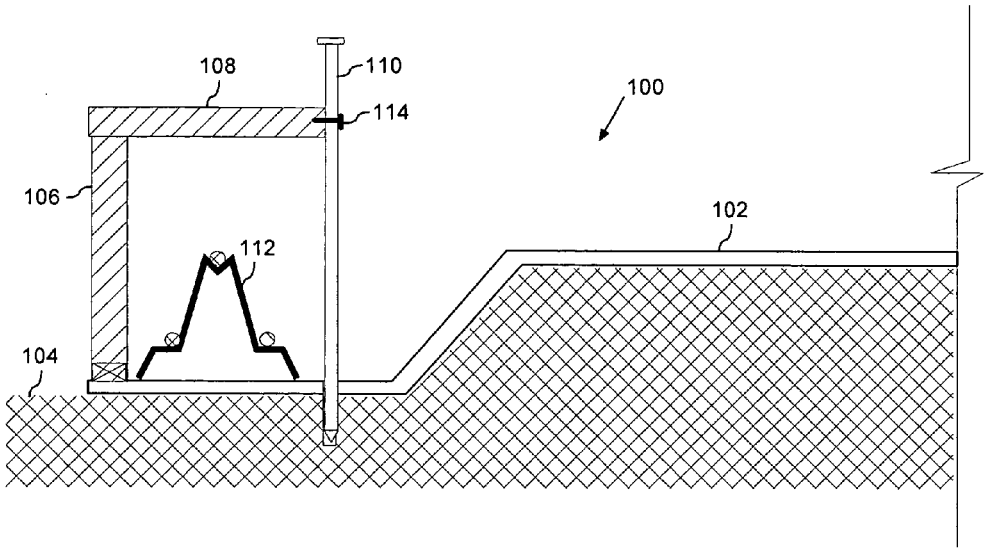
Fig. 1A (Prior Art)
FIGS. 1A and 1B are a series of drawings useful for understanding the prior art.
Figure 1B:
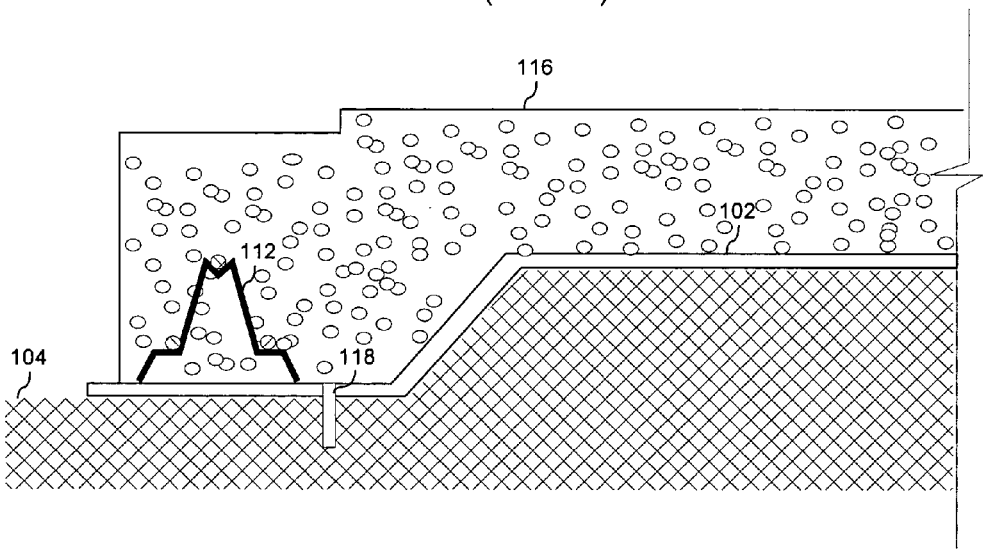
Fig. 1B (Prior Art)

FIG. 1A is a cross-sectional view of a portion of a typical building site 100 that has been prepared for the pouring of a concrete foundation. The building site includes a moisture barrier membrane 102 disposed over compacted soil 104, and a slab form 106 that will serve to contain a poured concrete slab until such times as it cures. Additional slab forms are conventionally disposed around a perimeter of the building site to constrain the wet concrete and define any necessary details in the foundation. For example, a form 108 can be used to create a depression in the slab for receiving a wood or metal structural member. Structural reinforcements 112 are typically provided along portions of the slab where heavy loading is anticipated. Rigid metal or wooden stakes, such as stake 110 are commonly used to hold the position of the various forms 106, 108 while the concrete is allowed to cure. Before the concrete is fully cured, the stake can be removed as shown in FIG. 1B and the surface of the concrete can be smoothed over to close any opening in the still uncured concrete that may be left behind by the now removed stake 110. Still, the removal of the stake 110 will leave an opening 118 in the moisture barrier membrane 102 that can allow moisture and insects direct access to the slab. This is highly undesirable.

Figures 2A, 2B:
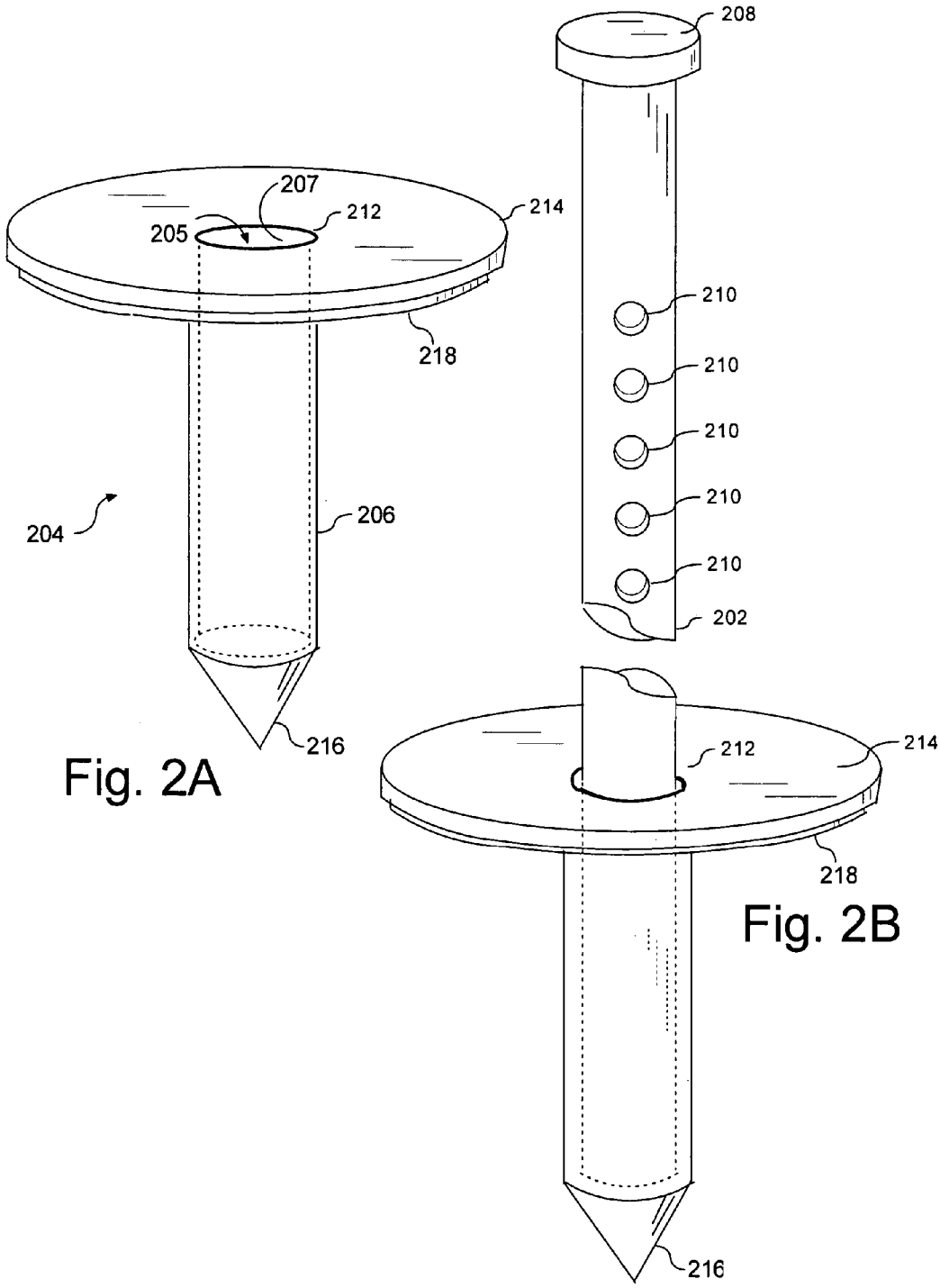
FIG. 2A is a perspective view of a plug for a concrete form stake that is useful for understanding the inventive arrangements.
FIG. 2B is a perspective view of the plug in FIG. 2A with an elongated stake disposed in a mating structure provided therein.

In order to overcome the deficiencies of the prior art, a plug can be disposed on one end of the stake that is intended to penetrate the soil. An example of such a plug is illustrated in FIG. 2A. At least an elongated body portion 206 of the plug 204 can be formed of a rigid material that is impervious to water. The plug must also have sufficient rigidity to penetrate a moisture barrier and be driven into compacted soil without significant deformation. Suitable materials can include fiber reinforced plastics, rigid polyvinyl chloride (RPVC), or any other rigid polymer plastic. Alternatively, the plug can be formed of a corrosion resistant metal, such as aluminum, brass, or galvanized steel.

The plug 204 can include a mating structure 205 for receiving a portion of a stake. For example, the plug can be at least partially hollowed out to define a bore 207 having a shape and size that is generally designed for receiving the stake therein. The cross-sectional profile of the bore will depend upon the particular type of stake that is used. Still, the invention is not limited in this regard, and any other suitable mating structure can be used for mating a stake to the plug 204 provided that plug is sufficiently coupled to the stake so that the plug can be driven by the stake into the underlying soil.

A flange 214 can be provided that protrudes around an outer periphery of the plug 204. The flange 214 can be formed of the same material as the plug 204 or can be a different material. For example, the flange 214 can be formed of a flexible polymer, such as silicone rubber, or any other flexible polymer that is waterproof, stable, and offers good long term resistance to environmental conditions present in the soil. If the flange 214 is formed of the same material as the plug 204, then the two parts can be integrally molded together. If the flange and the plug are formed of different materials, the flange 214 can be attached to the plug 204 in any suitable manner. For example, the flange 214 can be attached to a peripheral portion 212 of the plug 204 using a suitable adhesive. Further, the flange can extend within the bore 207 so as to form an inner lining extending partially or completely along the length of the bore 207.

FIG. 2B shows a stake 202 positioned within the mating structure 205 of plug 204. The stake can include an elongated body 203 that extends from a head 208 to an opposing tip 215. A portion of the stake body 203 is omitted from the drawing in FIG. 2 for greater clarity. However, it should be understood that the stake is continuous between the head 208 and the tip 215. Stake 202 can be formed of any rigid material that is suitable for being driven into compacted soil. For example, the stake can be formed of metal, wood, fiber reinforced plastics and so on.

The stake can have a circular cross-sectional profile as shown in FIG. 2, but any of a wide variety of other cross-sectional profiles is also acceptable. For example, square, rectangular and octagonal cross-sectional profiles are acceptable. Those skilled in the art will appreciate that the invention is not limited to any particular cross-sectional profile. The stake can have a tapered tip, but a blunt ended stake is preferred so that the stake is less likely to penetrate through the end of plug 204 when being driven into the soil. As shown in FIG. 2B, the head 208 can be slightly larger than the diameter of the remainder of the stake. However, an enlarged head 208 is also optional and head 208 can instead be of generally the same cross-sectional size as the body 203.

A series of bores 210 can be formed at locations distributed along at least an upper portion of the stake. The bores can be sized for receiving a fastening device such as a nail, peg or screw. In this way, the fastening device can be used to secure the concrete form to the stake while a concrete slab is poured and begins to cure.

Figure 3A:
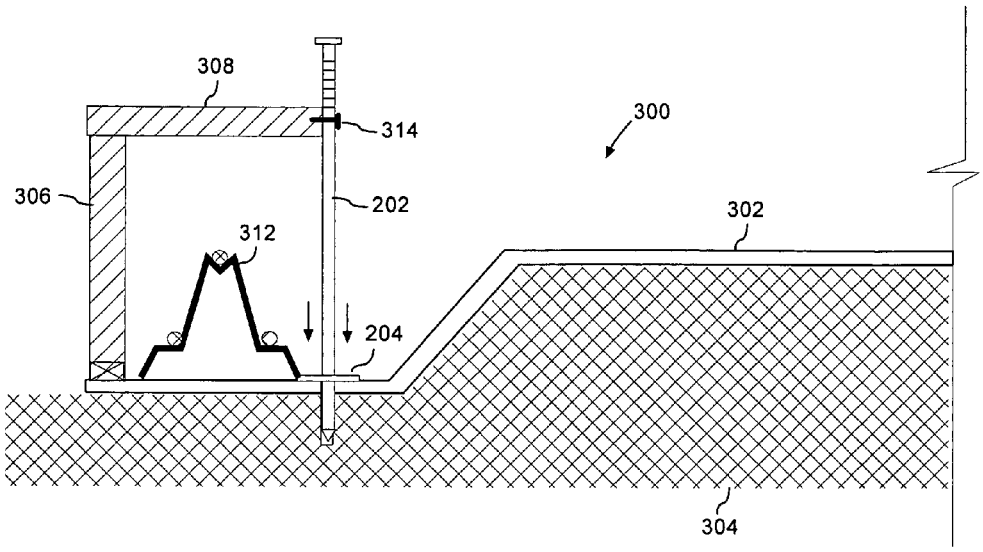
FIG. 3A is a cross-sectional view of a portion of a building site that has been prepared for the pouring a concrete foundation with the plug and stake in place.
Figure 3B:
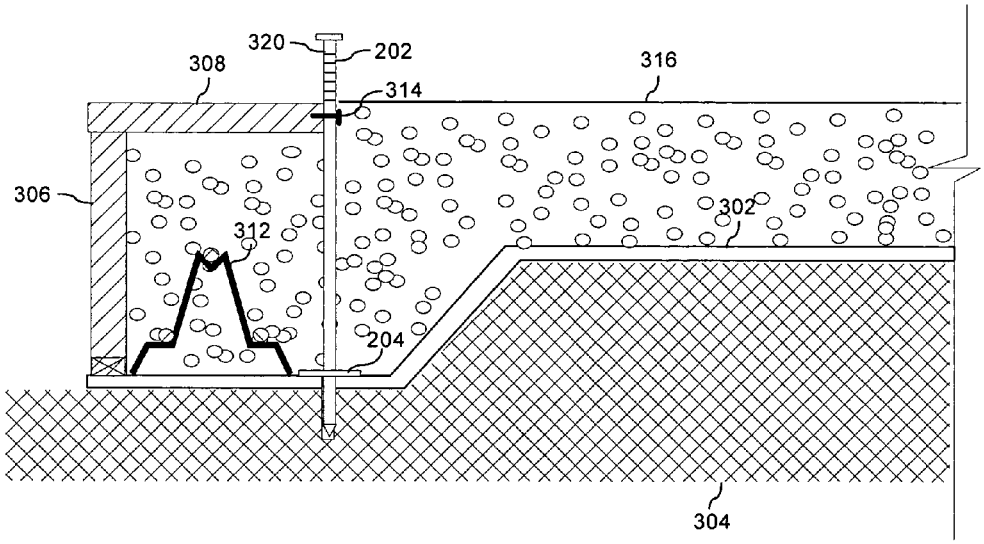
FIG. 3B shows the cross-sectional view of FIG. 3A in which concrete has been poured over the moisture barrier membrane.
Figure 3C:
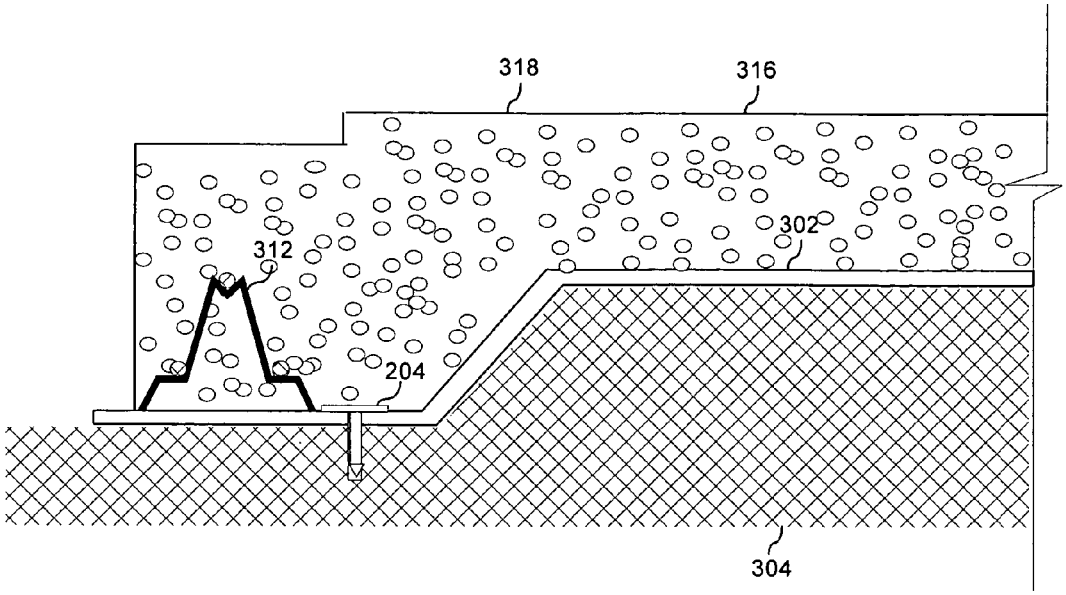
FIG. 3C shows the cross-sectional view of FIG. 3B in which the forms have been removed from the poured foundation and the stake has been removed from the plug.

The invention shall now be further described with reference to FIGS. 3A–3C. FIG. 3A shows a cross-sectional view of a portion of a building site 300 that has been prepared for the pouring of a concrete foundation. The building site includes a moisture barrier membrane 302 disposed over compacted soil 304, and a slab form 306 that will serve to contain a poured concrete slab until such times as it cures. As is well known in the art, additional forms can also be used for creating a building slab. For example, a form 308 can be used to create a depression in the slab for receiving a wood or metal structural member (not shown). Those skilled in the art will appreciate that the invention is not limited to those particular forms that are shown in FIGS. 3A–3C. Conventional rebar structural reinforcements 312 can also be provided along portions of the slab where heavy loading is anticipated.

Slab forms such as forms 308 and 306 can be secured in place using stake 202. Only one stake 202 is shown in FIG. 3A–3D. However, those skilled in the art will appreciate that a plurality of such stakes may be used to secure any number of forms 308 and 306 in multiple locations. A plug 204 can be disposed on the end of each stake as shown in FIG. 2B. Each plug 204 can pierce the moisture barrier membrane 302 and can be driven into the compacted soil beneath the building site. The combination of the stake 202 and the plug 204 can be used to hold the position of the various forms 306, 308 until such time as uncured concrete can be poured to create the slab. Advantageously, the plug 204 can be driven into the soil to a depth that is sufficient for securing the form and generally positions the flange 214 so that it fits snugly adjacent to an upper surface of the moisture barrier membrane 302. Fastening device 314 can be used to secure the various concrete forms to the stake 202 while the slab is poured and begins to cure. Fastening device 314 can be a nail, peg or screw, but the invention is not limited in this regard. Fastening device 314 can be any suitable structure capable of securing the form to the stake.

Referring now to FIG. 3B, concrete 316 can be poured to form the slab 316 using conventional techniques. In conventional systems the subsequent removal of each stake from the wet concrete leaves an opening in the moisture barrier membrane. In order to avoid this problem with the prior art plug 204 can be allowed to remain in place when the stake 202 is removed. FIG. 3C shows the plug 204 in place after the stake 202 has been removed and the concrete has been smoothed over. The retention of the plug 204 within the moisture barrier membrane avoids creating a substantial opening in the moisture barrier membrane that would be otherwise caused by the removal of the stake without a plug.

Figure 4:
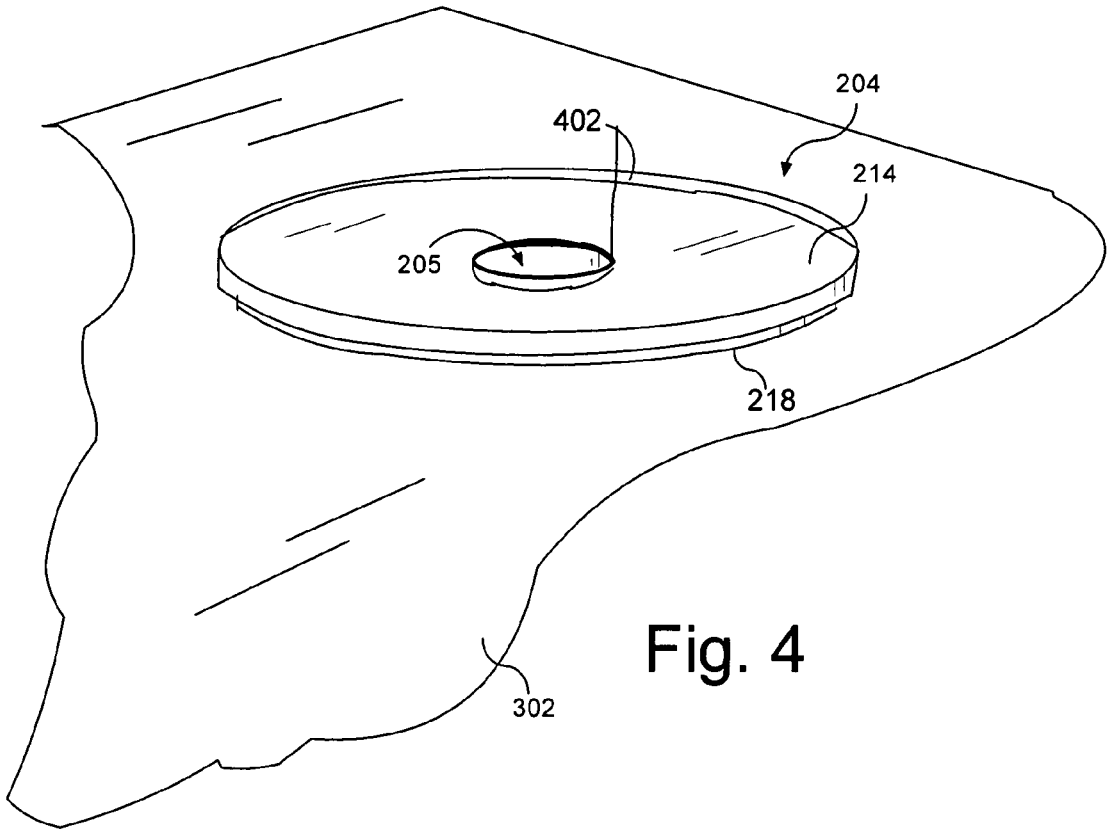
FIG. 4 is an enlarged perspective view showing a flange of the plug forming a seal around where the plug has pierced the moisture barrier membrane.

FIG. 4 is an enlarged view showing the plug 204 after the stake 202 has been removed. For purposes of clarity, the poured concrete that is disposed over the plug and the moisture barrier membrane is not shown in FIG. 4. However, it can be observed that the plug snugly engages the surface of the membrane in the area surrounding the location where the elongated body portion of the plug pierces the membrane. Further, the plug 204 can have a ridge 402 that is defined around an outer periphery of the flange as shown. A second ridge 402 can also be defined around the bore 205. The ridges can define between them a channel area that is suitable for containing a pesticide that has been sprayed or otherwise deposited on the surface of the plug.

According to one embodiment, a tip 216 of plug 204 can be sufficiently tapered, sharpened or otherwise formed so as to cleanly pierce the surface of the moisture barrier membrane 302 with a minimum of pulling, tearing or deformation of the membrane in the area surrounding the stake. Consequently, the moisture barrier membrane 302 can fit snugly around the outside of the stake 202 so as to substantially form a seal therewith. A waterproof sealing agent such as silicone rubber can optionally be applied around the periphery of the elongated body portion 206 where it pierces the moisture barrier membrane 302. In this way, exposure of the slab to water and insect intrusion can be further minimized.

The invention is not limited to any particular shape or taper formed on tip 216 provided that it cleanly pierces the surface of the moisture barrier membrane 302 with a minimum of pulling, tearing or deformation of the membrane in the area surrounding the stake. Such deformation and tearing can adversely affect any seal formed around the stake. Further, the tip 216 should have a profile that ensures that the shape of any opening formed in the moisture barrier membrane closely fits around the outer surface of the plug 204 where it passes through the membrane. At the present time, plugs having a sharp tapered tip and a circular cross-sectional outer profile are believed to serve this purpose best. However, the invention is not limited in this regard and any combination of tip shape and cross-sectional profile can be used provided that the requisite seal around the plug is formed.

Those skilled in the art will appreciate that, without some further sealing agent, the seal formed around the plug 204 when it pierces the moisture barrier membrane 302 may not be adequate in all instances to preclude moisture and insect intrusion. In such instances, it can be desirable to provide additional safeguards to form a more effective seal. Any suitable arrangement can be used to achieve this purpose. For example, in a second embodiment, the plug 204 can optionally be provided with a sealing material 218. As illustrated in FIGS. 2A and 2B, the sealing material 218 can be disposed on a underside of flange 214 suitable for creating a moisture seal between the flange and the membrane around the area where the plug pierces the moisture barrier membrane. The sealing material 218 can be comprised of a putty-like compound such as silicone rubber, a neoprene material or any other pliant material capable of forming a moisture-proof seal for substantially preventing the passage of moisture between the flange and the moisture barrier membrane. Alternatively, or in addition thereto, the sealing material 218 can be comprised of an adhesive that can be used to secure the flange and the opposing surface of the moisture barrier membrane 302.

According to one embodiment, the sealing material can be a sealant or adhesive that can be pre-disposed on the underside of the flange 214. Further, the adhesive or sealant can be protected by a non-stick tape that can be removed when the plug 204 is ready for use. In this way, the installer can be spared the additional labor of applying the sealant material around each of the plugs before piercing the moisture barrier membrane.

The invention claimed is:

1. A method for securing a foundation form disposed on a moisture barrier membrane comprising:

selecting a foundation form;

selecting a moisture barrier membrane;

selecting a concrete form stake;

selecting a plug;

positioning one end of said concrete form stake in a mating structure of said plug;

penetrating said moisture barrier membrane with a tip end of said plug;

forming a seal between a flange extending around a periphery of said plug and said moisture barrier membrane; and selecting said flange to include a flexible portion that forms a seal with said moisture barrier membrane.

2. The method according to claim 1 further comprising the step of forming said seal by driving said stake through said moisture barrier membrane until said flange is disposed adjacent to said moisture barrier membrane.

3. The method according to claim 1 further comprising the step of selecting said mating structure of said plug to include a bore that is shaped for receiving a portion of said stake.

4. The method according to claim 1 further comprising the step of forming said seal between said flange and said moisture barrier membrane using a sealing material.

5. The method according to claim 4 further comprising the step of selecting said flange to include a sealing material pre-disposed on a surface thereof.

6. The method according to claim 1 further comprising the step of selecting said mating structure so that said stake is removable from said plug after said seal has been formed.

7. The method according to claim 1 further comprising the step of securing said stake to said foundation form.

8. The method according to claim 7 wherein said securing step is further comprised of the step of driving at least one of a nail and a screw through a bore formed in said stake and into said foundation form.

9. The method according to claim 1 further comprising the step of removing said stake from said mating structure.

10. The method according to claim 1 further comprising the step of removing said stake from said mating structure after concrete has been poured over said moisture barrier membrane.

11. The method according to claim 1 further comprising the step of selecting said flange to include a ridge disposed on an outer rim thereof.

12. The method according to claim 11 further comprising the step of disposing a pesticide in a channel at least partially defined by said ridge.

13. A method for securing a foundation form disposed on a moisture barrier membrane comprising:

penetrating said moisture barrier membrane with a plug disposed on one end of a stake;

sealing a breach in said moisture barrier membrane caused by said penetrating step by forming a seal around a periphery of said plug; and removing at least a portion of said stake extending above said moisture barrier membrane.

14. The method according to claim 13 further comprising the step of positioning said stake in a mating structure of said plug that is shaped for receiving an end of said stake.

15. The method according to claim 13 further comprising the step of forming said seal by abutting a peripheral flange of said plug adjacent to said moisture barrier membrane.

16. The method according to claim 15 further comprising the step selecting said flange to include at least one of a flexible and a resilient portion that forms a seal with said moisture barrier membrane.

17. The method according to claim 15 further comprising the step of forming said seal between said flange and said moisture barrier membrane using a sealing material.

18. The method according to claim 15 further comprising the step of selecting said flange to include an adhesive pre-disposed on a surface thereof.

19. The method according to claim 13 further comprising the step of selecting said stake to include at least one bore extending through said stake in a direction transverse to an axis defined along a length of said stake.

20. The method according to claim 13 further comprising the step of securing said stake to said foundation form.

21. The method according to claim 20 wherein said securing step is further comprised of driving at least one of a nail and a screw through a bore, formed in said stake transverse to an axis defined along a length of said stake, and into said foundation form.

22. The method according to claim 14 wherein said removing step includes removing said stake from said mating structure after concrete has been poured over said moisture barrier membrane.

23. Apparatus for securing a foundation form disposed on a moisture barrier membrane comprising:

a moisture barrier membrane;

an elongated stake;

a plug disposed on an end of said stake, said plug having a peripheral flange configured for forming a seal with said moisture barrier membrane surrounding an elongated body portion of said plug; and a sealing material pre-disposed on a surface of said flange.

24. The apparatus according to claim 23 wherein said plug is slidably removable from said stake.

25. The apparatus according to claim 23 wherein said plug includes at least one of a flexible portion and a resilient portion.

26. The apparatus according to claim 23 wherein said plug includes a mating structure for removably attaching said plug to said stake.

27. The apparatus according to claim 26 wherein said mating structure comprises a bore disposed within said stake that is profiled for removably receiving said stake therein.

28. The apparatus according to claim 27 wherein said flange includes a ridge disposed on an outer rim thereof spaced apart from said bore.

29. The apparatus according to claim 27 further comprising a channel formed on said flange configured for receiving a fluid insecticide.

30. A prepared foundation site, comprising:

a moisture barrier membrane disposed over at least a portion of a foundation site;

a plurality of plugs traversing said moisture barrier membrane and embedded in a soil disposed beneath said moisture barrier membrane;

each of said plugs comprising an elongated body portion having a tip end and a peripheral flange, said peripheral flange disposed on a portion of said elongated body opposed from said tip end;

wherein said peripheral flange forms a seal with said moisture barrier membrane surrounding an area where said elongated portion of said plug traverses said moisture barrier membrane; and selecting a sealing material disposed between said flange and said moisture barrier membrane.

31. The prepared foundation site according to claim 30 wherein said moisture barrier membrane is disposed over compacted soil.

32. The prepared foundation site according to claim 30 wherein said flange includes a flexible portion that forms said seal with said moisture barrier membrane.

33. The prepared foundation site according to claim 30 wherein said plug includes at least one of a flexible portion and a resilient portion.

34. The prepared foundation site according to claim 30 wherein said seal between said flange and said moisture barrier membrane is formed using a sealing material.

35. The prepared foundation site according to claim 30 wherein said plug includes a mating structure for removably attaching said plug to a stake.

36. The prepared foundation site according to claim 35 wherein said mating structure comprises a bore disposed within said stake that is profiled for removably receiving said stake therein.

37. The prepared foundation site according to claim 36 wherein said peripheral flange includes a ridge disposed on an outer rim thereof spaced apart from said bore.

38. The prepared foundation site according to claim 36 further comprising a channel formed on said flange configured for receiving a fluid insecticide.

* * * * *

UNITED STATES PATENT AND TRADEMARK OFFICE

CERTIFICATE OF CORRECTION

PATENT NO. : 7,174,681 B2
APPLICATION NO. : 10/733901
DATED : February 13, 2007
INVENTOR(S) : Wilson et al.

It is certified that error appears in the above-identified patent and that said Letters Patent is hereby corrected as shown below:

On the Title page
Field (54), delete "CONCRETE FROM STAKE SYSTEM WITH SELF-SEALING PLUG" and replace with --CONCRETE FORM STAKE SYSTEM WITH SELF-SEALING PLUG--.

Column 1
Lines 1 and 2, delete "CONCRETE FROM STAKE SYSTEM WITH SELF-SEALING PLUG" and replace with --CONCRETE FORM STAKE SYSTEM WITH SELF-SEALING PLUG--.

Signed and Sealed this

Ninth Day of October, 2007

JON W. DUDAS
*Director of the United States Patent and Trademark Office*